US005111745A

United States Patent [19]

Wilson

[11] Patent Number: 5,111,745

[45] Date of Patent: May 12, 1992

[54] INK STAMPS

[76] Inventor: Tse M. S. Wilson, 16 Fontana Gardens, 6th Floor, Hong Kong, Hong Kong

[21] Appl. No.: 573,348

[22] Filed: Aug. 24, 1990

[51] Int. Cl.[5] ..... B41K 1/42

[52] U.S. Cl. ..... 101/333; 101/103; 101/405

[58] Field of Search ..... 101/103, 104, 333, 334, 101/327, 368, 405, 406

[56] References Cited

U.S. PATENT DOCUMENTS

| | | | |
|---|---|---|---|
| 4,022,127 | 5/1977 | Carlsson et al. | 101/327 |
| 4,203,362 | 5/1980 | Underwood et al. | 101/405 |
| 4,362,101 | 12/1982 | Ahrens | 101/327 |
| 4,594,943 | 6/1986 | Nettesheim et al. | 101/405 |
| 4,649,819 | 3/1987 | Voto, Jr. et al. | 101/327 |
| 4,735,143 | 4/1988 | Weir | 101/333 |

FOREIGN PATENT DOCUMENTS

| | | | |
|---|---|---|---|
| 704834 | 5/1950 | United Kingdom | 101/333 |
| 2226276 | 6/1990 | United Kingdom . | |

*Primary Examiner*—Edgar S. Burr
*Assistant Examiner*—Joseph R. Keating
*Attorney, Agent, or Firm*—Fredrikson & Byron

[57] ABSTRACT

An ink stamp with a handle having a downwardly extending shaft from which a pre-inked stamp is suspended. An intermediate member is threaded onto the shaft and abuts the top of a hollow base housing the pre-inked stamp to limit downward movement of the stamp when making an impression. A spring is positioned between the intermediate member and the base to urge the shaft and handle upwardly. Adjustment of the intermediate member along the shaft varies the extent of movement of the pre-inked stamp according to the amount of ink it holds.

3 Claims, 3 Drawing Sheets

INK STAMPS

This invention relates to ink stamps.

BACKGROUND TO THE INVENTION

In particular the invention relates to ink stamps of the type in which an ink impression is made on a substrate like a piece of paper by placing the stamp over the region to be printed and then resiliently depressing a handle to push an inked surface down onto the paper. For example an ink stamp of this type is shown in U.S. Pat. No. 4 022 127.

As explained in that Patent there are difficulties in ensuring that the correct amount of ink is expelled each time the stamp is used. Thus, as the stamping ink is consumed, the stamping block, which carries the inked surface, becomes thinner and so the handle needs to be depressed by differing amounts to ensure that only the right amount of ink is expelled and used each time. If the handle is depressed too far and the ink pad compressed too much then too much ink becomes expelled giving an unnecessarily heavy impression which may also have disadvantages of not drying quickly, and conversely, if the handle is not depressed far enough then equally the resulting printed impression may not be legible.

The above noted Patent describes one way of overcoming this problem by using a two part bushing of variable length. This is disposed between the handle and the base and stop means are provided to limit the amount the handle can be depressed. This amount can be varied by the relative rotation of the two part bushing. The arrangement is, however, relatively complicated both in the number of parts used and in the assembly and construction of the stamp.

It is, therefore, an object of the present invention to provide a stamp of this general type which is simpler and easier to construct.

BRIEF SUMMARY OF THE INVENTION

According to the invention there is provided an ink stamp, comprising a hollow base having downwardly extending side edges capable of resting on a surface to be provided with an inked impression so positioning the stamp over that surface, a pre-inked stamp having a lower relief printing surface positioned within that hollow base, an upwardly extending shaft from which the stamp is suspended and which can be moved downwardly relative to the base by a handle to bring the relief surface into contact with the surface to be given the impression, stop means joined to the handle to limit downward travel of the handle, the stop means being joined to the handle and/or shaft by a screw thread so that rotation of the stop means relative the shaft will adjust the position of the lower relief printing surface relative the handle and stop means, and resilient means for urging the handle and the ink stamp to an upper position, downward pressure on the handle overcoming the resilient means and pressing the inked relief surface against a support to be given the impression.

Such an arrangement is simple and uses a minimal number of parts. At the same time the parts are easy to assemble.

By rotating the stop means relative the shaft one can limit the extent by which the handle can be depressed against the resilient means. In this way one can quickly and easily adjust the extent to which the inked pad can be lowered and compressed during the stamping operation and so control the amount of ink deposited in the impression irrespective of the depletion of the ink and consequent changes in the thickness of the ink pad.

Preferably the stop means comprise an intermediate member which has an internal screw thread which meshes with an external screw thread on the shaft. Also the intermediate member preferably has a lower abutment surface which contacts the top of the hollow base when the handle is depressed so thereafter preventing further downward movement of the handle.

The resilient means can comprise a spring which urges the handle and shaft and intermediate member in an upward sense.

DESCRIPTION OF THE DRAWINGS

An ink stamp according to the invention will now be described, by a way of example, with reference to accompanying drawings, in which.

DESCRIPTION OF THE PREFERRED EMBODIMENT

Figure 1:
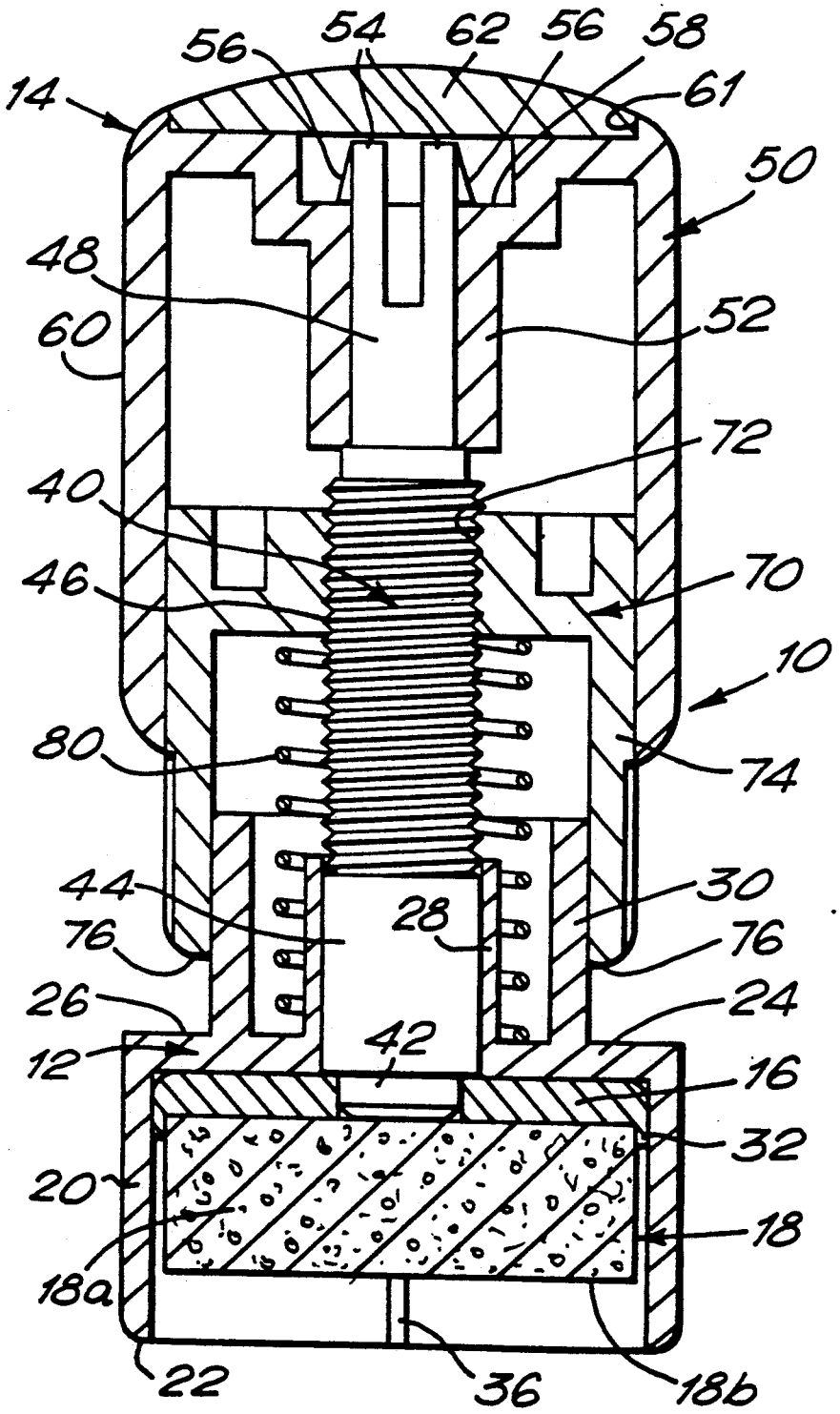
FIG. 1 is an upright section through the stamp.

The ink stamp 10 shown in the drawings comprises a hollow base 12 and an upstanding handle 14. In the hollow base 12 is a support 16 for a printing block 18. This is well known and comprises a pad **18*a* of porous material soaked with ink having a relief surface on its underface 18*b* which is not shown in detail. Such blocks 18** are well known and it is not believed that the block requires further explanation.

The base 12 in the example shown in the drawings is of substantially circular shape as seen in plan but this is not critical and alternatively its shape could be square or rectangular depending upon the shape and size of the block 18. It comprises an integral downwardly extending flange 20 having a lower edge 22 on which the stamp 10 can rest when not in use. Additionally the base 12 includes a substantially flat portion 24 from which the flange 20 extends and that portion 24 has a flat upper abutment surface 26 whose function will be described in due course. Also extending upwardly from the portion 24 are an integral inner sleeve 28 and an integral intermediate guiding sleeve 30.

The support 16 for the block is in the form of a circular inverted cup shaped member having a surrounding circular flange 32 for positioning the block 18. The block 18 is adhered in a suitable manner to the underside of the block 16. To prevent relative rotation between the support 16 and the base 12 a narrow radially inwardly projecting spline 36 is provided in the interior face of the flange 20 and the support 16 has a corresponding recess not shown in which that spline engages.

Extending centrally and upwardly from the support 16 is a shaft 40. At its lower end this has a portion 42 of reduced diameter which is screwed, stuck or otherwise permanently joined to a central opening in the support 16. The shaft 40 has at its lower end a cylindrical portion 44 which is a sliding fit within the sleeve 28, that sleeve guiding the shaft 40 as it moves up and down relative the sleeve. Above the portion 44 is a threaded region 46. At its upper end 48 the shaft is joined to a knob 50 comprising the handle 14.

The knob 50 has a central hollow sleeve 52 which receives the upper end 48 of the shaft. The latter has a pair of resilient fingers 54 having outwardly projecting stops 56. The knob has at its centre a small circular recess 58. Thus when the knob is assembled to the shaft 40, the fingers 54 can enter the lower sleeve 52 and become compressed together as they pass through the sleeve. Once they reach the recess 58 however, they can snap apart and the stops 56 will then lock the fingers 54 in place and so secure the knob 50 to the upper end of handle 40.

The knob also has an outer downwardly depending circular flange 60 by means of which the user grasps the knob. Also its upper surface has a recess 61 in which a disc 62 is positioned which can hide the top of the handle and also hold a sheet carrying, for example, information corresponding to the relief surface 18*b* so that the user can quickly see what stamp he is picking up.

An intermediate stop member 70 is positioned between the flange 60 and the shaft 40. This stop member has an inner threaded cylindrical surface 72 which engages with and is threaded onto the screw threaded region 46. Also, the intermediate member includes an integral downwardly dependent flange 74 and having a lower abutment end 76.

Between the sleeves 28 and 30 is positioned the lower end of a coil spring 80. This bears at its lower end against the base 12 and its upper end against the underside of the intermediate member 70. It therefore urges the intermediate member and therefore handle 14 upwardly away from the base 12 so also lifting the shaft 40 and keeping the support 16 at its upper limit position shown in FIG. 1 where the support engages the underside of the base 12 and retains the block 18 wholly within the base 12.

To operate the stamp the user places the stamp 10 onto a surface 82 (see FIG. 2) which is to be given the inked print. He then presses down on the handle 14 and this moves down against the effect of the spring 80 taking with it the stop member 70 and the shaft 40. As a result the support 16 and printing block 18 also move downwardly to the position shown in FIG. 2 where the underface 18*b* presses against the surface 82 and provides the necessary print.

As the knob 50 is moved downwardly the intermediate member 70 also moves downwardly and its abutment surface 76 eventually contacts the surface 26 on the base 12. When these two surfaces contact one another the handle cannot be moved downwardly any further. In the position shown in FIG. 2 it will be noted that these two surfaces are in contact at approximately the position where the underface 18*b* contacts the surface 82. It is impossible therefore for the user to compress the pad 18 any further, therefore, since any further downward pressure on the handle will not squeeze the block 18 but merely transfer that pressure directly via the surface 22 of the base 12 to the surface 82. Excessive ink therefore cannot be squeezed out of the block so forming a dirty or smudgy print.

Figure 3:
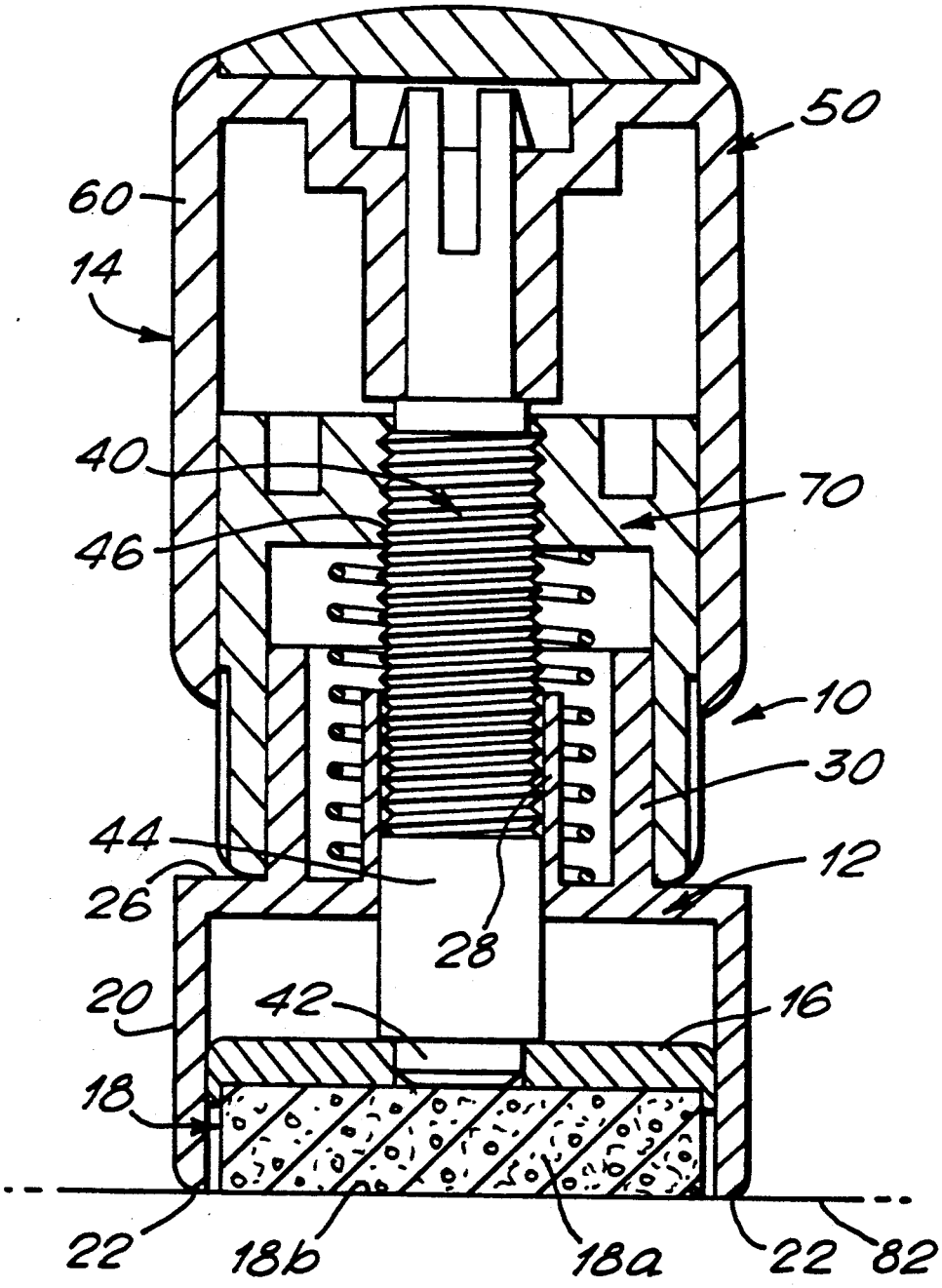
FIG. 3 is a section similar to FIG. 2 showing the stamp after adjustment once the ink in the ink pad has been depleted.

It is however well known that, as the block 18 becomes progressively depleted with ink, its overall thickness reduces and so from time to time it will be necessary to lower the block more than before in order that its underface 18*b* will contact the surface 82. This can be achieved by rotating the intermediate member 70 so that it threads its way up the shaft. FIG. 3 shows the situation where the block 18 has become considerably thinner and it will be noted that the intermediate member 70 has now been screwed significantly further up the shaft by simply rotating it relative the knob. Of course this adjustment will not be made all in one go but will be made progressively as the ink becomes depleted.

Figure 2:
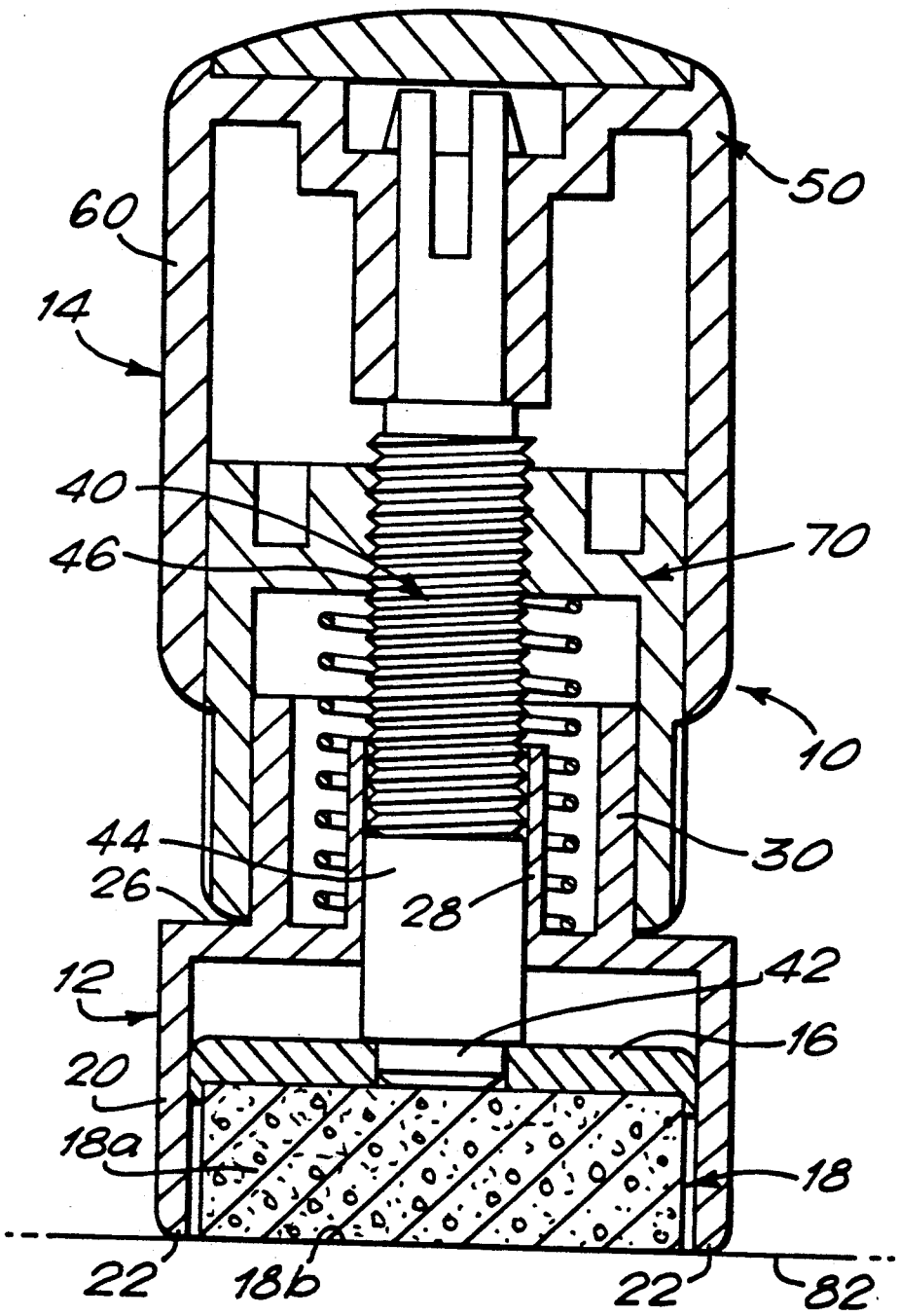
FIG. 2 is a similar section showing the stamp in use with the handle depressed to make an ink compression.

In the situation shown in FIG. 3 therefore it will be seen that with the intermediate member screwed further up the shaft 40 it is now possible for the support 16 to be pressed further down within the base 12 and so again it is possible for the user to bring the underface 18*b* into contact with the surface 82 to be given the impression in a similar way to the situation shown in FIG. 2.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. An ink stamp for making an inked impression on a surface, comprising:

a hollow base including a top abutment surface, an upwardly extending guide sleeve and downwardly extending side edges, said side edges having lower edges capable of resting on said surface to be provided with an inked impression so positioning the stamp over the surface;

a pre-inked stamp having a lower relief printing surface positioned within said hollow base;

an upwardly extending shaft slidably received within and extending through said guide sleeve and having an upper end, a lower end and an external screw thread over at least part of its length, said stamp being attached to said lower end of said shaft;

a handle affixed to said upper end of the shaft, said handle being movable downwardly relative to said base to bring said relief printing surface into contact with said surface to be given an inked impression;

an intermediate member mounted on said shaft separately from said handle, said intermediate member having an internal screw thread meshing with said external screw thread on the shaft and a lower abutment surface capable of contacting said top abutment surface on said hollow base to limit downward movement of said handle, shaft and stamp, whereby rotation of said intermediate member relative to said handle vertically adjusts the position of the lower relief printing surface once the lower and upper abutment surfaces are in contact; and a spring positioned between the upper abutment surface of the hollow base and the intermediate member to urge the intermediate member, shaft and handle upwardly, downward pressure on the handle overcoming the resiliency of the spring and pressing the relief printing surface against the surface to be given the impression.

2. An ink stamp according to claim 1 in which to prevent relative rotation between said pre-inked stamp and said hollow base, said base has an inwardly projecting spline and said stamp has a recess into which said spline projects.

3. An ink stamp according to claim 1 in which said upper end of said shaft has a number of resilient fingers with outwardly projecting stops, and said handle has a downwardly extending sleeve into which the upper end of said shaft is received, recess means being provided between the top of said sleeve and said handle into which said stops can snap to fix said handle to said shaft.

* * * * *